US012655643B2

(12) United States Patent
Weidner

(10) Patent No.: US 12,655,643 B2
(45) Date of Patent: Jun. 16, 2026

(54) SPACER FOR JOINING AND SEAM SEALING FLOOR COVERINGS

(71) Applicant: Keith Weidner, Spanaway, WA (US)

(72) Inventor: Keith Weidner, Spanaway, WA (US)

( * ) Notice: Subject to any disclaimer, the term of this patent is extended or adjusted under 35 U.S.C. 154(b) by 0 days.

(21) Appl. No.: 18/775,041

(22) Filed: Jul. 17, 2024

(65) Prior Publication Data

US 2026/0022573 A1 Jan. 22, 2026

(51) Int. Cl.

| | |
|---|---|
| ***E04F 21/00*** | (2006.01) |
| ***A47G 27/04*** | (2006.01) |
| ***E04F 15/16*** | (2006.01) |
| ***E04F 21/02*** | (2006.01) |

(52) U.S. Cl.
CPC ..... *E04F 21/0092* (2013.01); *A47G 27/0443* (2013.01); *E04F 15/16* (2013.01); *E04F 21/023* (2013.01)

(58) Field of Classification Search
CPC ..... E04F 21/0092; E04F 21/023; E04F 15/16; E04F 15/02005; E04F 13/0889; A47G 27/0443; A47G 27/0487; A47G 27/0268; C09J 5/00; B29C 65/4815
See application file for complete search history.

(56) References Cited

U.S. PATENT DOCUMENTS

| | | | | | |
|---|---|---|---|---|---|
| 2,980,943 | A * | 4/1961 | Calandro | A47G 27/0462 | 16/7 |
| 3,735,497 | A * | 5/1973 | Boettcher | E04F 21/0092 | 33/526 |
| 3,927,298 | A * | 12/1975 | Prater | B29C 66/43 | 156/391 |
| 4,557,774 | A * | 12/1985 | Hoopengardner | A47G 27/0437 | 156/92 |
| 4,893,449 | A * | 1/1990 | Kemper | E04F 19/066 | 52/717.06 |
| 5,010,654 | A * | 4/1991 | Funes, Jr. | E04F 21/0092 | 33/526 |
| 5,626,933 | A * | 5/1997 | Long | B29C 66/12449 | 428/53 |
| 5,756,176 | A * | 5/1998 | Feld | A47G 27/045 | 428/48 |
| 10,988,944 | B2 * | 4/2021 | Li | E04F 21/0092 | |
| 2019/0309531 | A1 * | 10/2019 | Li | B25B 7/02 | |
| 2023/0220685 | A1 * | 7/2023 | Hunt | E04F 21/0092 | 33/526 |

FOREIGN PATENT DOCUMENTS

| | | | | |
|---|---|---|---|---|
| AT | 2214 U1 * | 6/1998 | | E04F 19/066 |
| CA | 2821534 A1 * | 1/2015 | | |
| CA | 3007850 A1 * | 12/2018 | | E04F 19/061 |

* cited by examiner

*Primary Examiner* — William L Miller
(74) *Attorney, Agent, or Firm* — Thomas E. Loop

(57) ABSTRACT

A spacer designed for use with two pieces of carpet or floor covering maintains the edges of these pieces equidistant apart and above the floor. This arrangement aids in the application of seam sealer adhesive along the edges. The spacer includes a lower foot section in contact with the floor and an upper tower section with a notch-cut to hold the edge of the carpet. The spacer is flat and rigid, with the lower section having two feet separated by a gap, which may be semi-circular. The upper section's outer edges may be inwardly arcuate, and the device can be used with seam tape and seam sealer adhesive.

10 Claims, 5 Drawing Sheets

SPACER FOR JOINING AND SEAM SEALING FLOOR COVERINGS

TECHNICAL FIELD

The present invention relates generally to carpet or floor covering installation and, more specifically, to spacers and methods for facilitating the joining and seam sealing of abutting carpet and/or floor covering edges.

BACKGROUND OF THE INVENTION

When installing carpet or floor covering, it is often necessary to join multiple pieces together to cover a large area. This process typically involves positioning and aligning the edges of the carpet or floor covering pieces and applying a seam sealer (an adhesive to prevent fraying in the case of carpet) along with a seam tape to secure the pieces together in an aestehtically pleasing manner. However, maintaining the proper spacing and alignment between the carpet edges for seam sealer application can be challenging, especially when the carpet or floor covering is patterned (i.e., has a selected surface pattern thereon). In addition, traditional seam sealing methods can be messy resulting in unwanted seam sealer contamination on the visible nap portion of the carpet, resulting in an unacceptable seam.

Accordingly, there is a need in the art for tools and methods that can facilitate and streamline the process of installing and seam sealing carpeting (or other floor covering).

BRIEF SUMMARY OF THE INVENTION

In brief, and in a first aspect, a spacer is provided for holding opposing linear edges of two pieces of carpet or floor covering equidistant apart and above the floor, facilitating the application of seam sealer adhesive. The spacer includes a lower foot section in contact with the floor, an upper tower section connected to the lower foot section and substantially symmetrical about a vertical axis with opposing outer edges, and an inwardly and upwardly projecting notch-cut on an outer edge of the upper tower section to hold the carpet or floor covering. The spacer is substantially flat and rigid, with the lower foot section comprising separated feet defining a gap, which may be semi-circular. The upper tower section's outer edges may be inwardly arcuate. Additionally, a strip of seam tape can preferably be positioned on the floor between the feet, and seam sealer adhesive applied onto the opposing linear edges of the carpet or floor covering. A plurality of spacers can be positioned along the linear edges to hold the pieces in place.

In another aspect, the present invention is direct to a method for joining and seam sealing a first and second piece of carpet or floor covering together to yield a unified piece of carpet or floor covering. Thus, and in accordance with embodiments, a method is provided for joining and seam sealing a first and second piece of carpet or floor covering to yield a unified piece. The method includes providing the first and second pieces of carpet, each with a linear edge, and a plurality of spacers with an upper tower section and a lower foot section. The upper tower section has a notch-cut to hold the carpet along its edge. The carpets are positioned on the floor, abutting along their edges to define a seam, with seam tape positioned underneath. Spacers are aligned along the seam, and the carpet is draped over the spacers and retained within the notch-cuts. Seam sealer is applied to the edges, spacers are removed, and heat is applied along the seam to join and seal the carpets into a unified piece.

These and other aspects of the present invention will become more readily apparent to those of ordinary skill in the art when reference is made to the following detailed description in view of the accompanying drawings.

BRIEF DESCRIPTION OF THE DRAWINGS

The accompanying drawings illustrate several embodiments and different aspects of the present invention and, together with the detailed description, serve to explain certain principles and operation of the invention. It will be appreciated by those skilled in the art that the particular embodiments illustrated in the drawings and described herein are exemplary, and as such they do not limit the scope of the invention as established by the appended claims. Also, and because the drawings are intended to be illustrative and symbolic representations of certain exemplary embodiments, they are not necessarily drawn to scale. In addition, it is to be expressly understood that the relative dimensions and distances depicted in the drawings (and described in the "Details Description of the Invention" section) are exemplary and may be varied in numerous ways.

In the drawings like reference numerals are used to designate like features throughout the several views of the drawings.

DETAILED DESCRIPTION OF THE INVENTION

Figure 1:
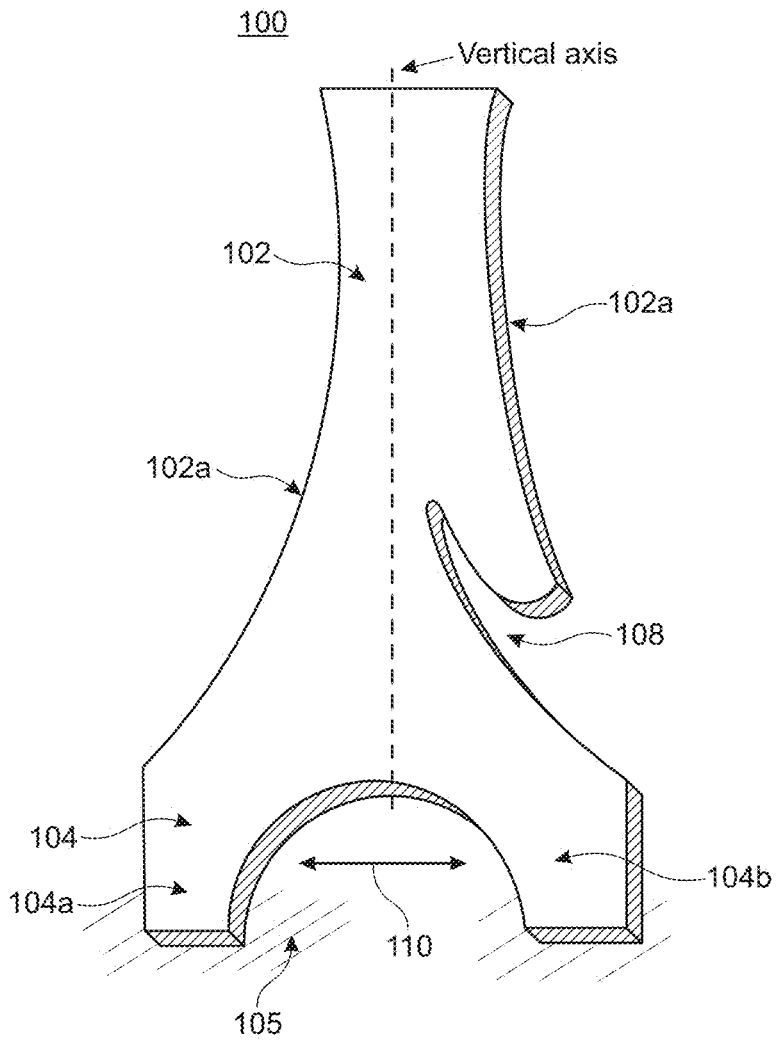
FIG. 1 illustrates a front view of a spacer in accordance with an embodiment of the present invention.
Figure 2:
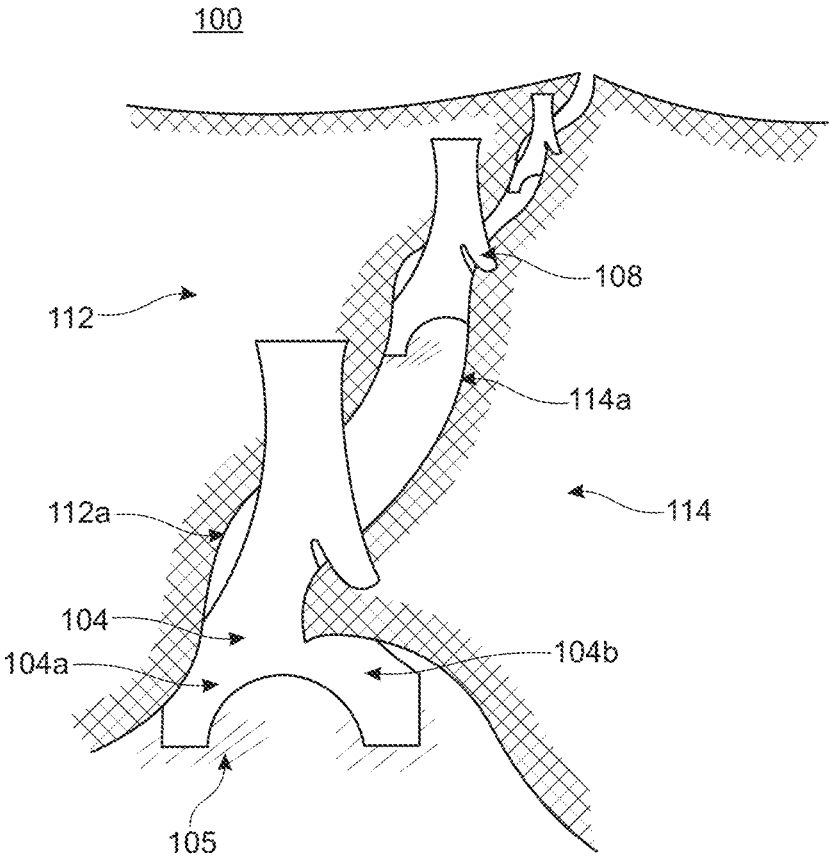
FIG. 2 illustrates an elevated perspective view of a plurality of spacers separating opposing pieces of carpet.
Figure 3:
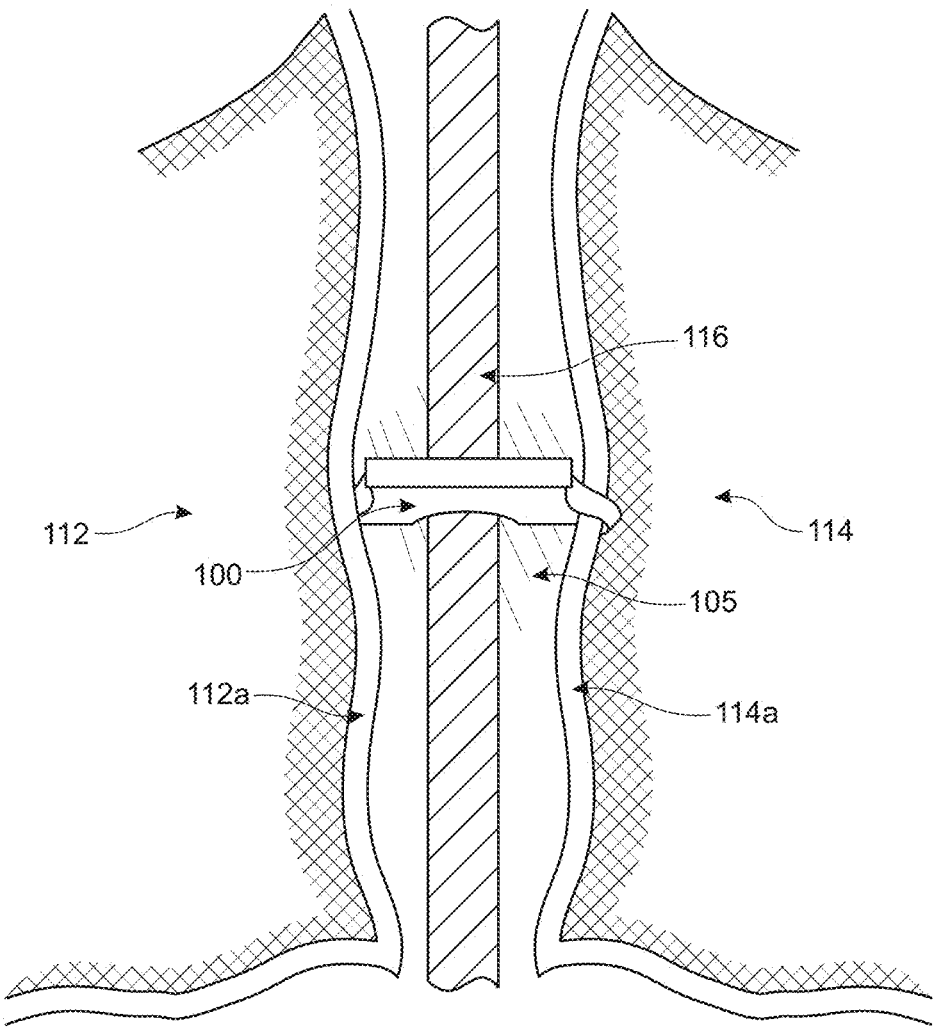
FIG. 3 illustrates a top perspective view of spacers with a strip of seam tape underneath.
Figure 4:
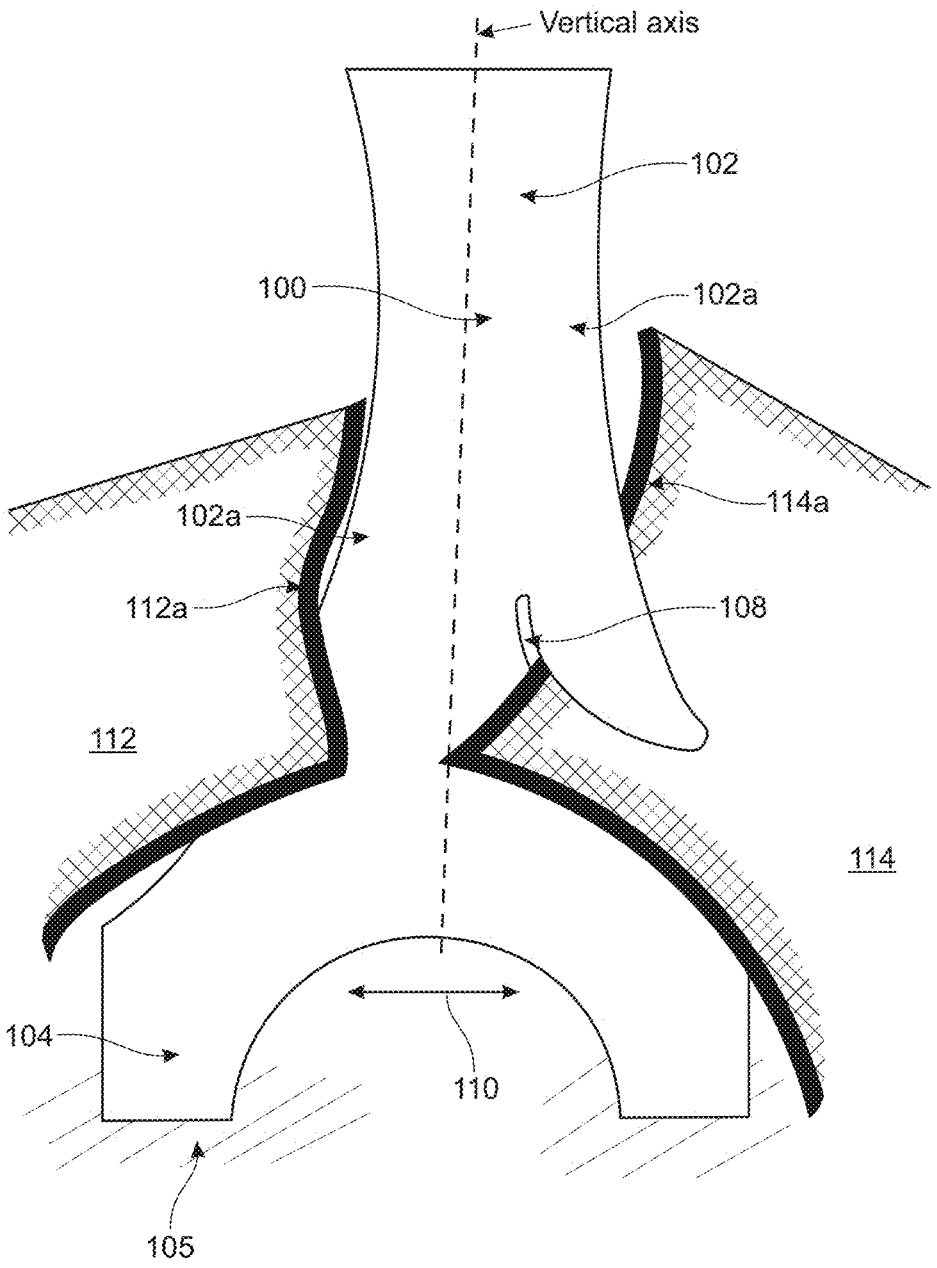
FIG. 4 illustrates a front view of a spacer being used to align and space apart first and second pieces of carpet prior to joining and seam sealing.

Referring now to drawings and especially FIGS. 1-4, the present invention in an embodiment is directed to a spacer 100 for holding opposing edges 112*a*, 114*a* of first and second pieces of carpet 112, 114 (or floor covering) at substantially the same distance apart from each other and above a floor 105 to allow seam sealer adhesive (not shown) to be applied along the opposing edges 112*a*, 114*a*. The spacer 100 includes a lower foot section 104 that is positioned on, and in contact with, the floor 105, and an upper tower section 102 connected to the lower foot section 104. The upper tower section 102 is substantially symmetrical about a vertical axis and has opposing outer edges 102*a*. As shown, an inwardly and upwardly projecting notch-cut 108 is positioned on an outer edge 102*a* of the upper tower section 102. The notch-cut is sized and configured to hold either the first or second piece of carpet 112, 114 (or floor covering) along its respective edge 112*a*, 114*a* and above the floor 105. The spacer 100 is preferable substantially flat and rigid and, thus, is preferably may be made of wood or plastic. The lower foot section 104 may include a first foot portion 104*a* and a second foot portion 104*b* separated by a gap 110 (e.g., semi-circular). The opposing outer edges 102*a* of the upper tower section 102 may be inwardly arcuate as shown. A strip of seam tape 116 may be positioned on the floor 105 between the first foot portion 104*a* and second foot portion 104*b*, seam sealer adhesive (not shown) may be applied along the opposing edges of carpet 112, 114 (or floor covering), and multiple spacers 100 may be positioned at regular intervals along the edges 112*a*, 114*a*.

Figure 5:
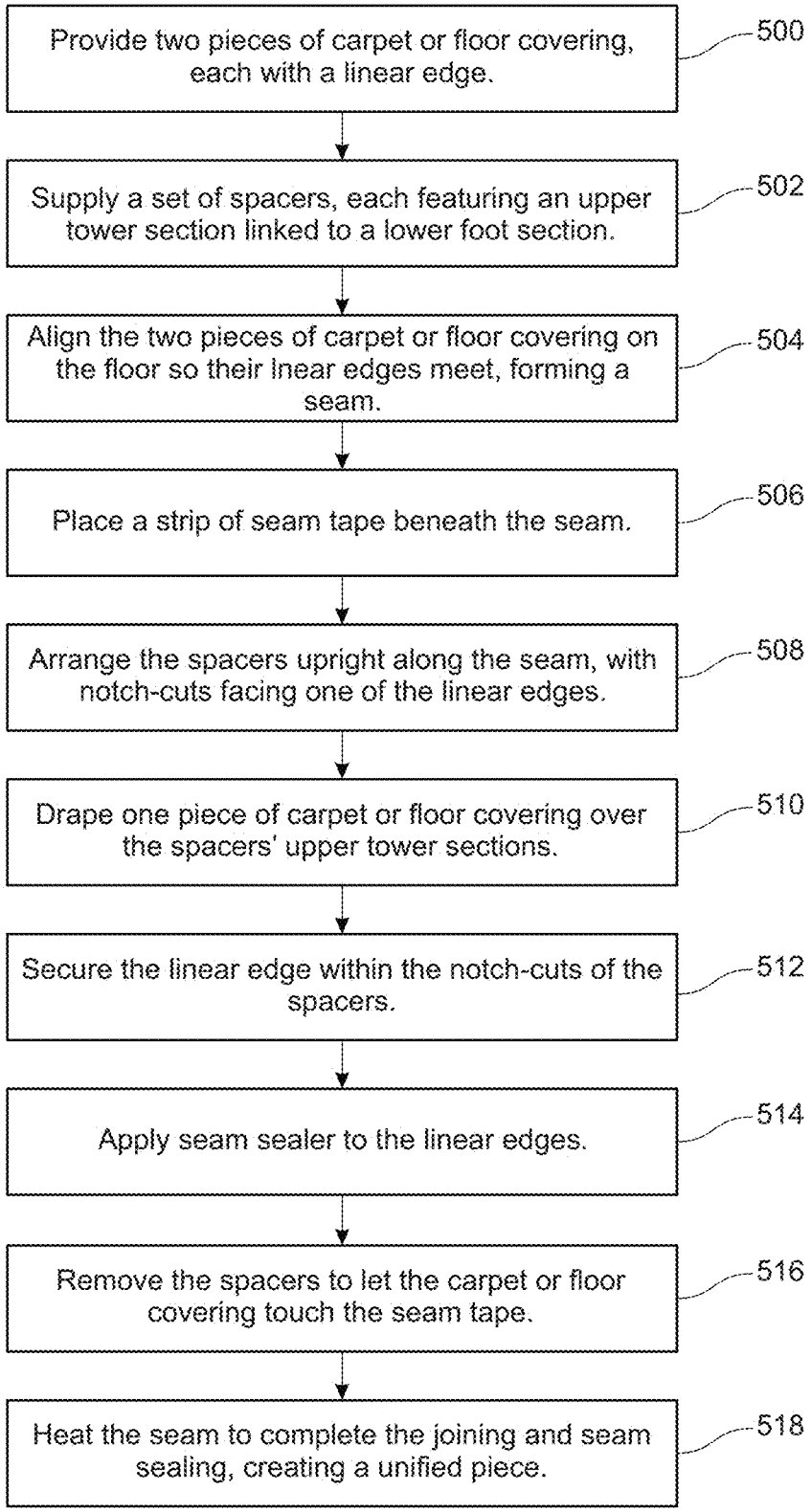
FIG. 5 illustrates a block diagram of the steps associated with joining and seaming opposing carpet edges in accordance with an embodiment of the present invention.

In another aspect and with reference to FIG. 5, the present invention is further directed to a method for joining and seam sealing a first and second piece of carpet or floor covering together to yield a unified piece of carpet or floor covering. The method comprises the following steps:

Step 500—providing the first and second pieces of carpet or floor covering, wherein the first and second pieces of carpet or floor covering each have a linear edge.

Step 502—providing a plurality of spacers, wherein each spacer comprises an upper tower section connected to a lower foot section, wherein the upper tower section is substantially symmetrical about a vertical axis and has opposing outer edges, and an inwardly and upwardly projecting notch-cut positioned on an outer edge of the upper tower section, wherein the notch-cut is sized and configured to hold either the first or second piece of carpet or floor covering along its linear edge and above the floor.

Step 504—positioning and aligning the first and second pieces of carpet or floor covering on a floor such that the first or second piece of carpet or floor covering abut each other along their linear edges thereby defining a seam.

Step 506—positioning a strip of seam tape under the seam.

Step 508—positioning and aligning the plurality of spacers on the floor and along the seam and in an upright position such the plurality of notch-cuts face one of the linear edges of the first or second piece of carpet or floor covering.

Step 510—draping the first or second piece of carpet or floor covering over the upper tower sections of the plurality of spacers.

Step 512—retaining the one of the linear edges of the first or second piece of carpet or floor covering within the plurality of notch-cuts.

Step 514—applying a seam sealer to the linear edges of the first or second piece of carpet or floor covering.

Step 516—removing the plurality of spacers such that the first or second piece of carpet or floor covering contacts the strip of seam tape under the seam.

Step 518—applying heat along the seam thereby joining and seam sealing the first and second piece of carpet or floor covering together to yield the unified piece of carpet or floor covering.

If the first and second piece of carpet or floor covering are patterned, the method may further comprise the step (Step 120) of sliding the first or second piece of carpet or floor covering not within the plurality of notch-cuts along the direction of the seam such that the patterns of the first and second piece of carpet or floor covering match.

While the present invention has been described in the context of the embodiments illustrated and described herein, the invention may be embodied in other specific ways or in other specific forms without departing from its spirit or essential characteristics. Therefore, the described embodiments are to be considered in all respects as illustrative and not restrictive. The scope of the invention is, therefore, indicated by the appended claims rather than by the foregoing description, and all changes that come within the meaning and range of equivalency of the claims are to be embraced within their scope.

What is claimed is:

1. In combination with a first and second piece of carpet or floor covering, a spacer for holding opposing edges of the first and second pieces of carpet or floor covering substantially equidistant apart from each other and above a floor, thereby facilitating the application of a seam sealer adhesive along the opposing edges, the spacer comprising:

a lower foot section positioned on, and in contact with, the floor;

an upper tower section connected to the lower foot section, wherein the upper tower section is substantially symmetrical about a vertical axis and has opposing outer edges; and an inwardly and upwardly projecting notch-cut positioned on an outer edge one of the outer edges of the upper tower section, wherein the notch-cut is sized and configured to hold either the first or second piece of carpet or floor covering along its linear edge a linear edge thereof and above the floor.

2. The combination of claim 1 wherein the spacer is substantially flat and rigid.

3. The combination of claim 2 wherein the lower foot section further comprises a first and second foot, wherein the first and second foot are separated from each other thereby defining a gap between them, and wherein the first and second foot are each on, and in contact with, the floor.

4. The combination of claim 3 wherein the gap is in the form of a semi-circle.

5. The combination of claim 3 wherein the opposing outer edges of the upper tower section are inwardly arcuate.

6. The combination of claim 5, further comprising a strip of seam tape positioned on the floor and between the first and second foot.

7. The combination of claim 6, further comprising the seam sealer adhesive applied onto the opposing linear edges of the first and second pieces of carpet or floor covering.

8. The combination of claim 7, further comprising a plurality of the spacers positioned along and holding the linear edges of the first and second pieces of carpet or floor covering.

9. A method for of joining and seam sealing a first and second piece of carpet or floor covering together to yield a unified piece of carpet or floor covering, the method comprising the steps of:

providing the first and second pieces of carpet or floor covering, wherein the first and second pieces of carpet or floor covering each have a linear edge;

providing a plurality of spacers, wherein each spacer comprises an upper tower section connected to a lower foot section, wherein the upper tower section is substantially symmetrical about a vertical axis and has opposing outer edges, and an inwardly and upwardly projecting notch-cut positioned on an outer edge of the upper tower section, wherein the notch-cut is sized and configured to hold either the first or second piece of carpet or floor covering along a linear edge thereof and above the floor;

positioning and aligning the first and second pieces of carpet or floor covering on a floor such that the first and second pieces of carpet or floor covering abut each other along their linear edges thereby defining a seam;

positioning a strip of seam tape under the seam;

positioning and aligning the plurality of spacers on the floor and along the seam and in an upright position such the plurality of notch-cuts face one of the linear edges of the first or second piece of carpet or floor covering;

draping the first or second piece of carpet or floor covering over the upper tower sections of the plurality of spacers;

retaining the one of the linear edges of the first or second piece of carpet or floor covering within the plurality of notch-cuts;

applying a seam sealer to the linear edges of the first or second piece of carpet or floor covering;

removing the plurality of spacers such that the first or second piece of carpet or floor covering contacts the strip of seam tape under the seam; and applying heat along the seam thereby joining and seam sealing the first and second piece of carpet or floor covering together to yield the unified piece of carpet or floor covering.

10. The method of claim 9 wherein first and second piece of carpet or floor covering each include a pattern, further comprising the step of sliding the first or second piece of carpet or floor covering not within the plurality of notch-cuts along the direction of the seam such that the patterns of the first and second piece of carpet or floor covering match.

* * * * *